United States Patent [19]

Nichols

[11] Patent Number: 4,687,009

[45] Date of Patent: Aug. 18, 1987

[54] ADJUSTABLE FILTER CIGARETTE AND METHOD OF MANUFACTURE THEREOF

[75] Inventor: Walter A. Nichols, Richmond, Va.

[73] Assignee: Philip Morris Incorporated, New York, N.Y.

[21] Appl. No.: 832,234

[22] Filed: Feb. 24, 1986

[51] Int. Cl.[4] ..... A24D 3/04

[52] U.S. Cl. ..... 131/336; 131/198.1; 131/198.2; 131/94

[58] Field of Search ..... 131/336, 94, 198.1, 131/198.2

[56] References Cited

U.S. PATENT DOCUMENTS

| | | |
|---|---|---|
| 3,327,718 | 6/1967 | Kilburn . |
| 3,359,988 | 12/1967 | Thomson . |
| 3,376,874 | 4/1968 | Kim et al. . |
| 3,428,050 | 2/1969 | Kandel . |
| 3,503,406 | 3/1970 | Riegel et al. . |
| 3,504,678 | 4/1970 | Pitt . |
| 3,512,537 | 5/1970 | Pelletier . |
| 3,608,561 | 9/1971 | Dock . |
| 3,738,375 | 6/1973 | Doumas . |
| 3,789,855 | 2/1974 | Norman . |
| 4,340,074 | 7/1982 | Tudor . |
| 4,532,943 | 8/1985 | Nichols et al. . |

FOREIGN PATENT DOCUMENTS

| | | |
|---|---|---|
| 1058343 | 2/1967 | United Kingdom . |
| 2099678 | 12/1982 | United Kingdom . |

*Primary Examiner*—V. Millin

*Attorney, Agent, or Firm*—Jeffrey H. Ingerman

[57] ABSTRACT

A variable dilution cigarette is provided having two-layer laminated tipping. Dilution patterns and break lines are formed in the layers before they are laminated. The laminate is applied to a segmented filter such that the dilution pattern of one layer moves relative to that of the other, changing their degree of registry and varying the dilution value of the cigarette, as the filter segments are rotated relative to one another. Because the two dilution patterns can be formed separately, non-linear dilution variation is possible, as well as more nearly constant resistance-to-draw. A method of manufacturing the cigarette is also provided.

16 Claims, 15 Drawing Figures

FIG. 4
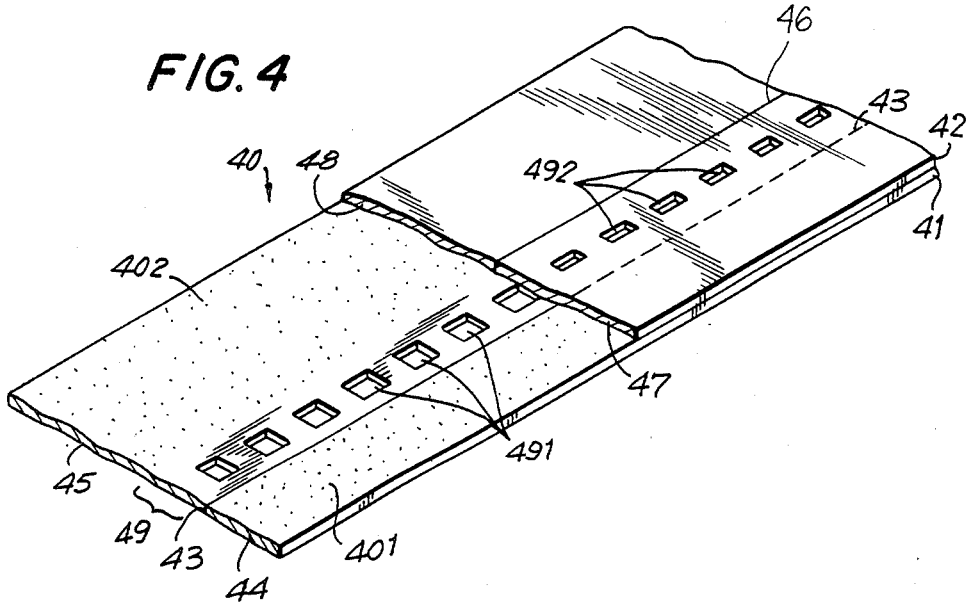
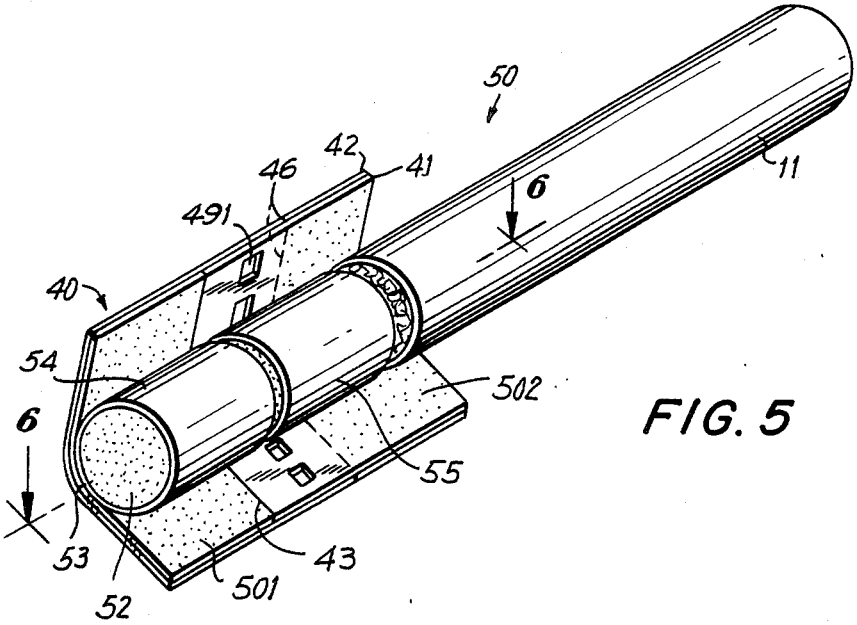
FIG. 5

FIG. 6
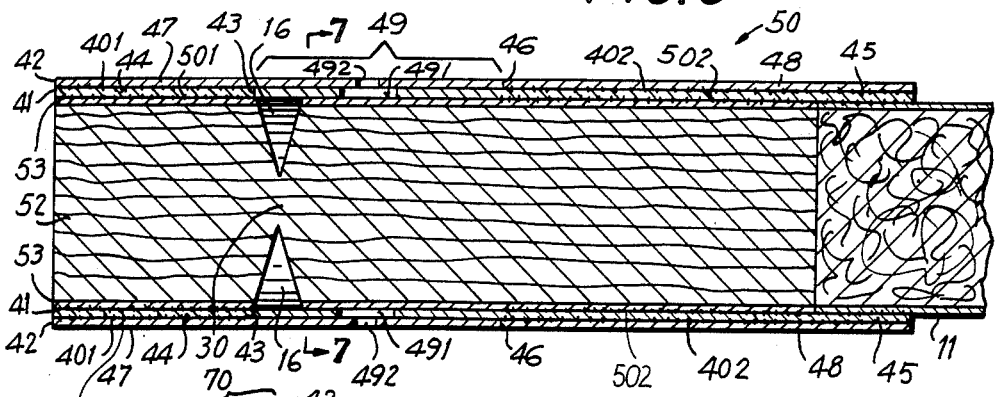
FIG. 7
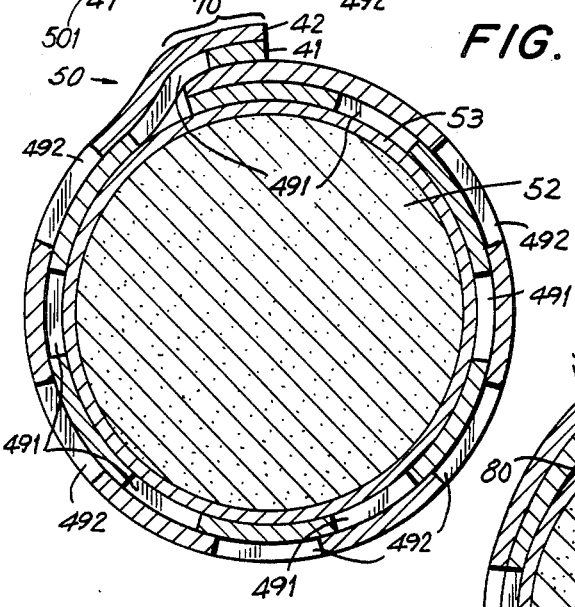
FIG. 8
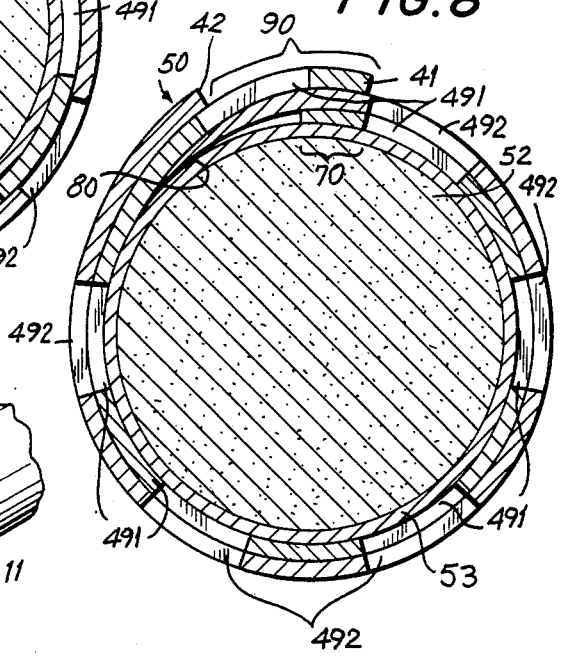
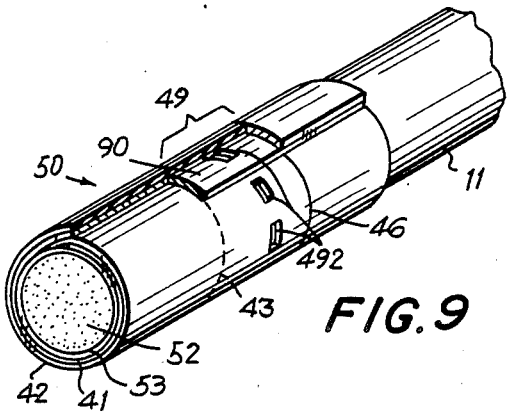
FIG. 9

ADJUSTABLE FILTER CIGARETTE AND METHOD OF MANUFACTURE THEREOF

BACKGROUND OF THE INVENTION

This invention relates to filter cigarettes. More particularly, the present invention relates to filter cigarettes which are adjustable by the smoker to vary the air dilution value.

It is known to produce variable dilution cigarettes having integral rotatable elements for controlling dilution. The rotatable element can be a rotatable band of tipping paper retained by stationary bands against axial displacement and having a slit overlying a slit in the filter plug wrap with which it can be rotated into and out of registry. Alternatively, it can be a rotatable section of the filter plug, carrying with it a section of tipping paper extending over a stationary section of the filter plug. The extending section of the tipping paper has a slit which overlies a slit in the plug wrap on the stationary filter plug segment. The slits can be moved in and out of registry by rotating the rotatable filter segment. Such a cigarette is described in commonly-assigned U.S. Pat. No. 4,532,943, which is hereby incorporated by reference in its entirety.

In the manufacture of these types of cigarettes, the slits in the tipping paper and plug wrap are most easily formed by simultaneously slitting both layers with a knife or laser beam mounted on the cigarette making machine. The cigarettes are therefore assembled initially with the slits fully in registry both longitudinally and rotationally. The dilution level can then be adjusted by rotating the rotatable segment, varying the rotational registry of the slits.

In such a cigarette, it is intended that the longitudinal registry of the slits not change as the filter segments are rotated. However, with certain constructions, rotation of the rotatable segment may cause longitudinal motion of the rotatable segment, affecting the longitudinal registry of the slits and impairing control of the dilution level.

Also in such a cigarette, the resistance-to-draw of the cigarette decreases as dilution increases, unless additional elements are incorporated into the cigarette, as described in said above-incorporated application.

It would be desirable to be able to provide a variable dilution cigarette of the type described above, and a method of manufacture thereof, in which the slits can be formed in the tipping paper before the cigarette is assembled, so that the cigarette making machine need not include a knife or a laser beam.

It would also be desirable to be able to provide a variable dilution cigarette of the type described above, and a method of manufacture thereof, in which the resistance-to-draw remains more nearly constant as dilution is varied, without the incorporation of additional elements in the cigarette.

It would also be desirable to be able to provide a variable dilution cigarette of the type described above, and a method of manufacture thereof, in which a change in the longitudinal registry of the slits does not affect control of the variable dilution feature.

SUMMARY OF THE INVENTION

It is an object of this invention to provide a variable dilution cigarette of the type described above, and a method of manufacture thereof, in which the slits can be formed in the tipping paper before the cigarette is assembled, so that the cigarette making machine need not include a knife or a laser beam.

It is another object of this invention to provide a variable dilution cigarette of the type described above, and a method of manufacture thereof, in which the resistance-to-draw remains more nearly constant as dilution is varied, without the incorporation of additional elements into the cigarette.

It is a further object of this invention to provide a variable dilution cigarette of the type described above, and a method of manufacture thereof, in which a change in the longitudinal registry of the slits does not affect control of the variable dilution feature.

In accordance with this invention, a filter cigarette is provided which comprises a substantially cylindrical tobacco rod, a substantially cylindrical filter plug, and a tipping paper laminate circumscribing the filter plug and a portion of the tobacco rod. The filter plug has an air-permeable periphery and a mouth end and a rod end open to the passage of air and smoke. The filter plug comprises a mouth-end segment axially connected to a rod-end segment for rotation about the axis of the cigarette, each segment having a mouth end and a rod end and a respective length. The tipping paper laminate comprises an inner tipping paper layer and an outer tipping paper layer, at least one of which is substantially air-impermeable. Each layer has a mouth end and a rod end. One layer is divided into a first mouth-end band and a first rod-end band along a line spaced from the mouth end of the layer by at most the length of the mouth-end filter segment. The other layer is divided into a second mouth-end band and a second rod-end band along a line spaced from the rod end of the layer by at most the sum of the length of the rod-end filter segment and the length of the circumscribed portion of the tobacco rod. The first layer rod-end band thereby overlaps the second layer mouth-end band in an overlap region between the division lines. The first layer mouth-end band is adhered to the second layer mouth-end band and the first layer rod-end band is adhered to the second layer rod-end band such that the overlap region is free of adhesive. The tipping paper laminate is adhered to the filter plug except in the overlap region. The inner layer has a first pattern of openings in the overlap region, and the outer layer has a second pattern of openings in the overlap region for registry with the first pattern.

When the mouth-end filter segment is rotated relative to the rod-end filter segment, the first and second layers move relative to one another in the overlap region, varying the registry of the first and second patterns of openings, thereby varying the air-dilution value of the cigarette.

In a method according to the invention for manufacturing the cigarette, the inner and outer layers of tipping paper are provided. The division line and the first perforation pattern are formed in the inner layer, and the division line and the second perforation pattern are formed in the outer layer. Adhesive is applied to the inner and outer layers except in the overlap region and the layers are adhered to form the tipping paper laminate. The tobacco rod and filter plug are provided and adhesive is applied to the inner side of the tipping paper laminate except in the overlap region. The filter plug and a portion of the tobacco rod are then overwrapped by the tipping paper laminate.

BRIEF DESCRIPTION OF THE DRAWINGS

The above and other objects and advantages of the invention will be apparent after consideration of the following detailed description, taken in conjunction with the accompanying drawings, in which like reference characters represent like parts throughout, and in which:

FIG. 4 is a fragmentary perspective view of one embodiment of the tipping paper laminate of this invention;

FIG. 5 is an exploded perspective view taken from the mouth end of a cigarette according to this invention;

FIG. 6 is a fragmentary longitudinal cross-sectional view of the cigarette of FIG. 5, taken from line 6—6 of FIG. 5;

FIG. 7 is a radial cross-sectional view of the cigarette of FIGS. 5 and 6 in a first rotational condition, taken from line 7—7 of FIG. 6;

FIG. 8 is a radial cross-sectional view of the cigarette of FIGS. 5–7 in a second rotational condition, taken from line 7—7 of FIG. 6;

FIG. 9 is a fragmentary perspective view taken from the mouth end of the cigarette of FIGS. 5–8 in the rotational condition shown in FIG. 8;

DETAILED DESCRIPTION OF THE INVENTION

Figure 1:
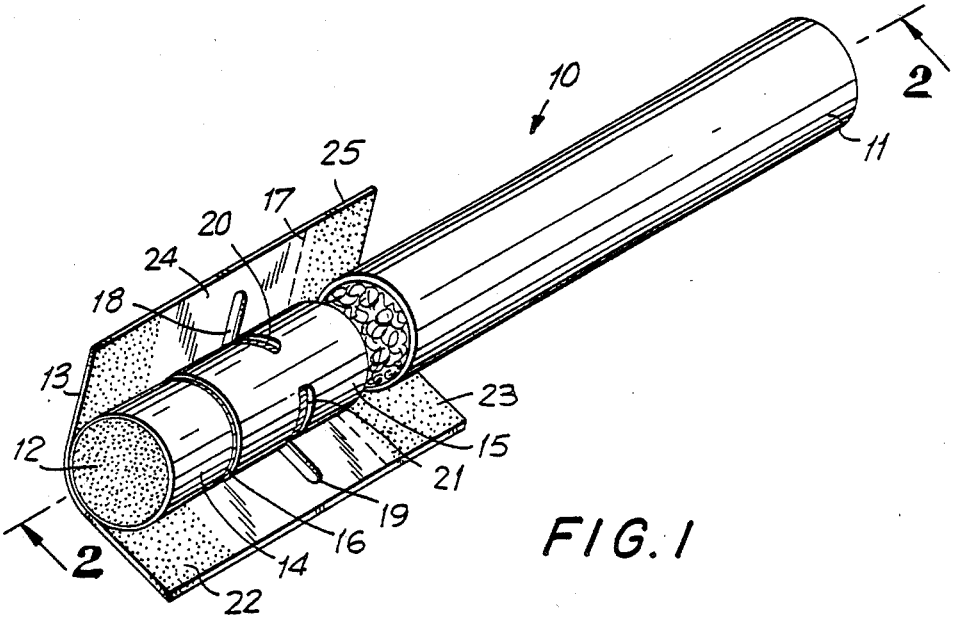
FIG. 1 is an exploded perspective view taken from the mouth end of a variable dilution cigarette with which the present invention may be used.
Figure 2:
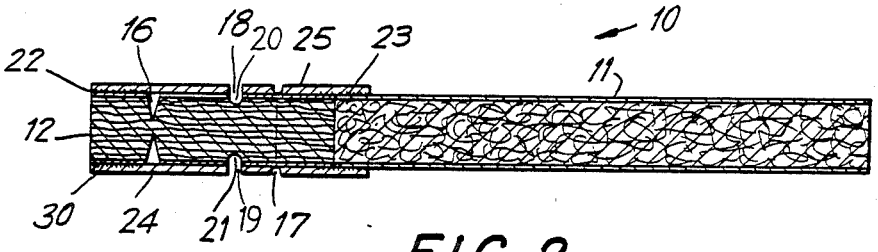
FIG. 2 is a cross-sectional view of the cigarette of FIG. 1, taken from line 2—2 of FIG. 1.
Figure 3:
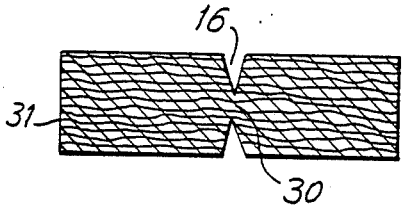
FIG. 3 is a cross-sectional view of the filter plug of the cigarette of FIGS. 1 and 2.

A cigarette of the type described in said above-incorporated commonly-assigned U.S. Pat. No. 4,532,943 is illustrated in FIGS. 1–3. The cigarette 10 comprises a tobacco rod 11—that is, a charge of smoking material wrapped in cigarette paper—attached to an axially aligned, wrapped cylindrical filter plug 12, and tipping paper 13. The filter plug 12 has a mouth end and a rod end, both of which are open to permit passage of air and smoke, and is divided into first and second segments 14, 15 by a circumferentially extending cut 16 which defines a central, axial core 30 about which the first segment 14 can be rotated relative to the second segment 15. The tipping paper 13 circumscribes and joins the filter plug 12 to the tobacco rod 11 in abutting end-to-end relation. Tipping paper 13 extends from substantially the mouth end of the filter plug 12, where it is fastened to segment 14 by adhesive band 22, to a point on the tobacco rod 11 adjacent the rod end of the filter plug 12, where it is fastened to both segment 15 and tobacco rod 11 by adhesive band 23. Tipping paper 13 also has a perforated break line 17 at a point between the circumferential cut 16 and the tobacco rod 11, dividing it into two tipping paper sections 24, 25.

Two openings 18, 19 are made through the tipping paper 13 corresponding to two openings 20, 21 in the underlying portion of the filter plug wrap. When perforation line 17 is broken, tipping paper section 24 is free to rotate with first segment 14 of the filter plug 12 about the axis of central core 30, such that openings 18, 19 in the tipping paper 13 and openings 20, 21 in the underlying portion of the plug wrap are in varying degrees of registry. Adjustment of the degree of registry permits varying amounts of air to enter the filter and combine with the smoke, thereby varying the air dilution value of the cigarette.

As described above, such cigarettes are assembled by providing a filter plug such as untipped filter plug 31, shown in FIG. 3, and attaching it to a tobacco rod 11 by overwrapping both untipped plug 31 and rod 11 with a length of tipping paper 13 which has already been provided with perforated break line 17. The tipping paper 13 is bonded by adhesive band 22 to the mouth end of filter plug 31 and by adhesive band 23 to the rod end of filter plug 31 and to the adjacent end of tobacco rod 11. A pair of slits is made through both tipping paper 13 and the wrapping of untipped filter plug 31 by a knife or laser beam, or other suitable means, simultaneously forming openings 18 and 20 and openings 19 and 21, transforming untipped filter plug 31 into filter plug 12.

When segment 14 of filter plug 12 is rotated immediately after being assembled as described above, the twisting of central axial core 30 will cause core 30 to tend to shorten. However, because the portions of opposing filter segments 14, 15 radially outward of core 30 are in direct contact, core 30 cannot shorten. Instead, the fibers of core 30 stretch or lengthen to maintain the same overall core length while twisted. Because of the stresses and strains involved, they may never return to their original lengths. As a result, when segment 14 is rotated toward a more relaxed position of core 30, segment 14 may move slightly away from segment 15. Therefore, even when openings 18, 19 and 20, 21 are in rotational alignment, they may no longer be in longitudinal alignment, and the functioning of the variable dilution mechanism may be impaired.

The possibility of impairment of the functioning of the variable dilution mechanism can be minimized by reducing or eliminating the longitudinal motion of segments 14, 15. One way of reducing or eliminating the longitudinal motion is disclosed in copending, commonly-assigned U.S. patent application Ser. No. 761,631, filed Aug. 1, 1985.

The possibility of impairment of the functioning of the variable dilution mechanism can also be alleviated by constructing the cigarette in such a way that the variable dilution mechanism is insensitive to relative longitudinal motion of the filter segments. One such cigarette is disclosed in copending, commonly-assigned U.S. patent application Ser. No. 799,747, filed Nov. 19, 1985.

Figure 15:
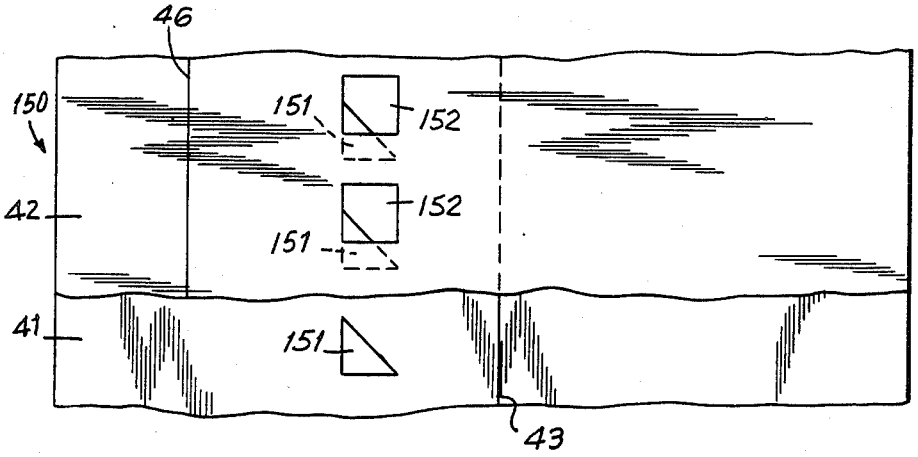
FIG. 15 is a fragmentary plan view of an alternative embodiment of the tipping paper laminate of this invention.

Another such cigarette is shown in FIGS. 5–14 and uses the tipping paper laminate of FIGS. 4 and 15. Tipping paper laminate 40 has inner tipping paper layer 41 and outer tipping paper layer 42, at least one of which is substantially air-impermeable. Inner tipping paper layer 41 is divided by division line 43 into first mouth-end band 44 and first rod-end band 45. Outer tipping paper layer 42 is divided by division line 46 into second mouth-end band 47 and second rod-end band 48. The spacing of division lines 43, 46, which will be described in more detail below, is such that first rod-end band 45 and second mouth-end band 47 overlap in overlap region 49. Inner tipping paper layer 41 has a first pattern of openings 491 in overlap region 49. Outer tipping paper layer 42 has a second pattern of openings 492 in overlap region 49. Laminate 40 is formed by adhering inner and outer tipping paper layers 41, 42 to one another with adhesive bands 401, 402. There should be no adhesive in overlap region 49.

A first embodiment 50 of a cigarette according to this invention, incorporating laminate 40, is shown in FIGS. 5–9. Cigarette 50 has a tobacco rod 11 and a filter plug 52. Filter plug 52 is similar to filter plug 12, except that plug wrapping 53 is air-permeable. Filter plug 52 could also be wrapperless as in FIG. 14, in which case it would have some type of supporting peripheral layer, such as a heat-fused layer, which would have to be air-permeable. Tobacco rod 11 and filter plug 52 are circumscribed by tipping paper laminate 40, which is adhered by adhesive band 501 to mouth-end filter segment 54 and by adhesive band 502 to rod-end filter segment 55 and to tobacco rod 11. Adhesive bands 501, 502 are directly under adhesive bands 401, 402. Inner and outer mouth-end bands 44, 47 rotate with mouth-end filter segment 54 while inner and outer rod-end bands 45, 48 remain stationary relative to rod-end filter segment 55, such that first rod-end band 45 moves in relation to second mouth-end band 47 in overlap region 49.

Inner layer division line 43 should be formed no further from the mouth end of inner layer 41 than the length of mouth-end filter segment 54, while outer layer division line 46 should be formed no further from the rod end of outer layer 42 than the sum of the length of rod-end filter segment 55 and the length of the circumscribed portion of tobacco rod 11. This assures that, as long as adhesive bands 501, 502 are coextensive with adhesive bands 401, 402, no tipping paper segment will be adhered to more than one filter segment. As illustrated in FIGS. 7 and 8, adhesive bands 501, 502 must be coextensive with adhesive bands 401, 402, or at least must not intrude into overlap region 49.

As shown in FIGS. 7 and 8, the edges of tipping paper laminate 40 are overwrapped at 70. Because outer tipping layer 42 moves relative to inner tipping layer 41, layers 41, 42 interleave, with outer tipping layer 42 intruding, for example, between inner tipping layer 41 and plug wrapping 53 at 80, if outer tipping layer 42 is moved counterclockwise as shown in FIGS. 7 and 8. Therefore, if that area were not free of adhesive, the degree of relative rotation achievable between filter segments 54, 55 would be severely limited.

Another result of the overwrap at 70 is shown in FIGS. 8 and 9. As tipping layer 42 is moved counterclockwise, a flap 90 of inner tipping layer 41 is increasingly exposed. By making at least the portion of inner tipping layer 41 in overlap region 49 a different color than outer tipping layer 42, or by printing other indicia thereon, a visual indicator of the degree of relative rotation between filter segments 54, 55 can be provided.

Variable dilution is achieved with cigarette 50 as the openings of first pattern 491 move relative to those of second pattern 492, varying the degree of registry therebetween. In FIG. 7, the openings are fully out of registry; in FIG. 8, they are fully in registry. First and second portions of openings 491, 492, as well as division lines 43, 46 are preferably formed in their respective tipping layer 41 or 42 before layers 41, 42 are laminated to form tipping laminate 40. Division lines 43, 46 are preferably formed as perforation lines, allowing the tipping paper layers 41, 42, and consequently tipping laminate 40, to remain in one piece during assembly of cigarette 50. The perforations are broken when rod filter segment 54 is rotated for the first time after cigarette 50 is assembled, either before packaging or by the smoker.

Because the openings in patterns 491 and 492 are not formed simultaneously, as they are in cigarette 10, the openings in the two patterns can be different. As shown in FIGS. 4 and 5, the openings of first pattern 491 are approximately square, while those of second pattern 492 are elongated slits having approximately the same circumferential extent as those of pattern 491. As a result, cigarette 50 is insensitive to the type of minor longitudinal misalignment described above in connection with cigarette 10. As best seen in FIG. 6, openings 492 have leeway to move longitudinally in either direction without moving out of registry with openings 491.

Another advantage of being able to provide different openings in tipping layers 41, 42 is that nonlinear variation of dilution is possible, as well as variation patterns that allow a more constant resistance-to-draw. For example, in the embodiment 150 of a tipping laminate according to this invention, shown in FIG. 15, outer layer 42 has a pattern of openings 152 similar to pattern 491 in embodiment 40 of FIG. 4. However, inner layer 41 has a pattern of openings 151 which have an isosceles right triangular shape, with one of the sides parallel to and collinear with the edges of openings 152 closest to the mouth end (to the left in FIG. 15). These patterns 151, 152 provide nonlinearly variable dilution. Each incremental rotational increase in the registry between openings 151, 152 increases dilution by an amount greater than the amount of increased dilution resulting from the previous incremental rotational increase in registry. In addition, these patterns 151, 152 provide more constant resistance-to-draw. As dilution is increased, the additional air entering the cigarette enters further from the mouth end. Therefore it must travel through additional filter material before reaching the smoker's mouth. The additional filter material partially offsets the drop in resistance-to-draw caused by the entry of additional air, resulting in a smaller overall drop in resistance-to-draw than if the same amount of air were admitted by pattern 492. Other nonlinear patterns are also possible.

In cigarette 50 of FIGS. 5–9, overlap region 49 overlies rod-end filter segment 55 and outer tipping layer 42 moves relative to stationary outer layer 41 in region 49. Other embodiments are shown in FIGS. 10–14.

Figure 10:
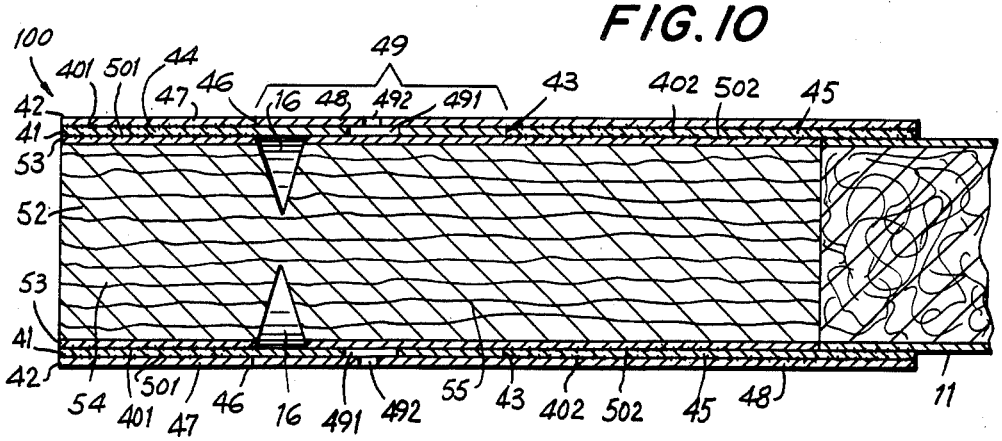
FIGS. 10–14 are fragmentary longitudinal cross-sectional views of alternative embodiments of the cigarette of FIGS. 5–9.
Figure 11:
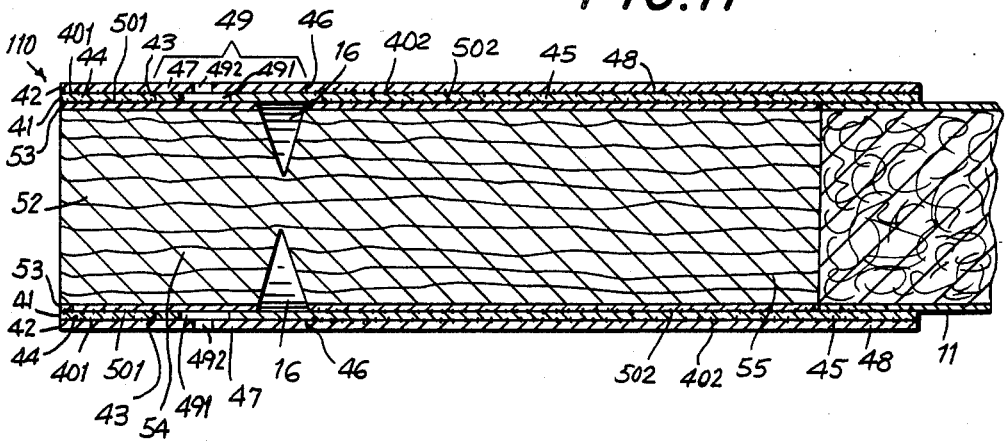
Figure 12:
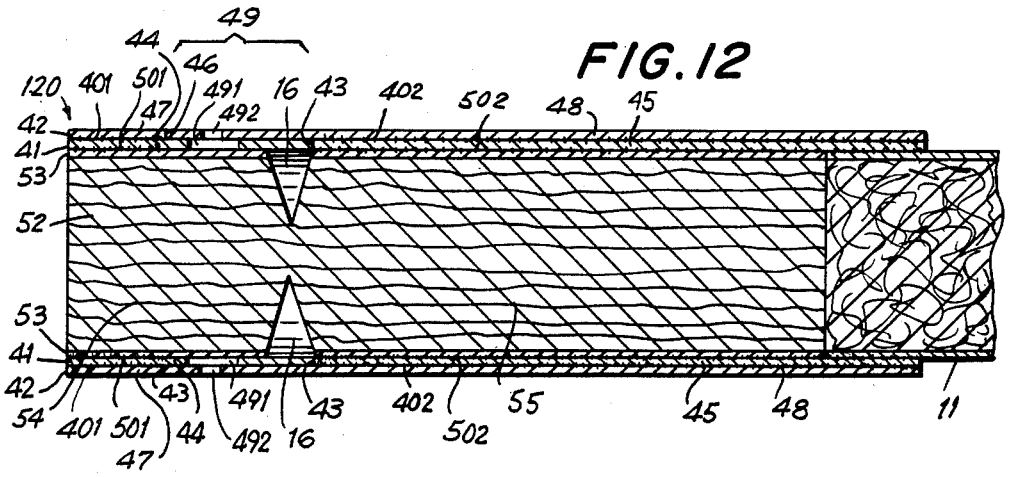
Figure 13:
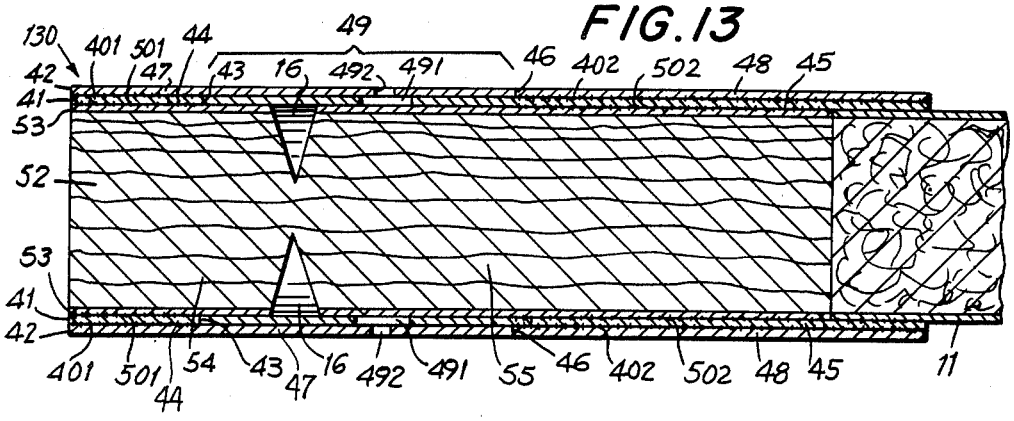
Figure 14:
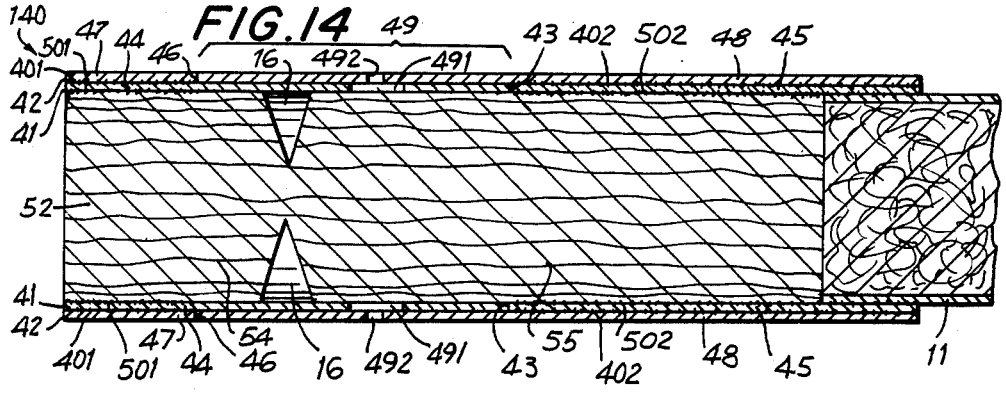

In cigarette 100 of FIG. 10, overlap region 49 overlies rod-end filter segment 55, and inner tipping layer 41 moves relative to stationary outer layer 42 in region 49. In cigarette 110 of FIG. 11, overlap region 49 overlies mouth-end filter segment 54 and outer tipping layer 42 moves relative to stationary inner layer 41 in region 49. In cigarette 120 of FIG. 12, overlap region 49 overlies mouth-end filter segment 54 and inner tipping layer 41 moves relative to stationary outer layer 42 in region 49. In cigarette 130 of FIG. 13, overlap region 49 overlies both filter segments 54, 55 and outer tipping layer 42 moves relative to stationary inner layer 41 in overlap region 49. In cigarette 140 of FIG. 14, overlap region 49 overlies both filter segments 54, 55 and inner tipping layer 41 moves relative to outer layer 42 in region 49. Cigarette 140 also has a wrapperless filter, as discussed above.

All of the embodiments of FIGS. 5 and 10–14 are within the scope of this invention as long as whichever of division lines 43, 46 is closer to the mouth end of the cigarette is no further from the mouth end than the lenth of mouth-end filter segment 54, and whichever of division lines 43, 46 is further from the mouth end of the cigarette is no further from the rod end of tipping laminate 40 than the sum of the length of rod-end filter segment 55 and the length of the portion of tobacco rod 11 that is circumscribed by tipping laminate 40.

Thus, a variable dilution filter cigarette of the type initially described is provided in which the dilution openings can be formed before the cigarette is assembled, the dilution pattern can be nonlinear, and the resistance-to-draw remains more nearly constant as the dilution level varies. One skilled in the art will appreciate that the present invention can be practiced by other than the embodiments described, which are presented for purposes of illustration and not of limitation, and the present invention is limited only by the claims which follow.

What is claimed is:

1. A filter cigarette comprising:

a substantially cylindrical tobacco rod;

a substantially cylindrical filter plug having an air-permeable periphery and a mouth end and a rod end open to the passage of air and smoke, and comprising a mouth-end segment axially connected to a rod-end segment for rotation about the axis of the cigarette, each of said segments having respective mouth and rod ends and respective lengths; and a tipping paper laminate circumscribing said filter plug and a portion of said tobacco rod; wherein:

said tipping paper laminate comprises an inner tipping paper layer, and an outer tipping paper layer, at least one of said layers being substantially air-impermeable, each of said layers having a mouth end and a rod end, one of said layers being divided into first mouth-end and first rod-end bands along a line spaced from the mouth end of said layer by at most the length of said mouth-end filter segment, the second of said layers being divided into second mouth-end and second rod-end bands along a line spaced from the rod end of said layer by at most the sum of the length of said rod-end filter segment and the length of said portion of said tobacco rod, such that said first layer rod-end band overlaps said second layer mouth-end band in an overlap region between said division lines, said first layer mouth-end band being adhered to said second layer mouth-end band and said first layer rod-end band being adhered to said second layer rod-end band such that said overlap region is free of adhesive;

said tipping paper laminate is adhered to said filter plug except in said overlap region; and said first layer has a first pattern of openings in said overlap region and said second layer has a second pattern of openings in said overlap region for registry with said first pattern;

such that when said mouth-end filter segment is rotated relative to said rod-end filter segment, said first and second layers move relative to one another in said overlap region, varying the registry of said first and second patterns of openings, thereby varying the air dilution value of said filter cigarette.

2. The filter cigarette of claim 1 wherein said filter plug is wrapperless and has an air-permeable peripheral layer.

3. The filter cigarette of claim 1 wherein said filter plug is circumscribed by an air-permeable plug wrapping.

4. The filter cigarette of claim 1 wherein said first and second layers are both substantially air-impermeable.

5. The filter cigarette of claim 1 wherein said first layer is said inner layer and said second layer is said outer layer.

6. The filter cigarette of claim 5 wherein the distance from the mouth end of said inner layer to the inner layer division line is equal to the length of said mouth-end filter segment and the distance from the rod end of sid outer layer to the outer layer division line is less than the sum of the length of said rod-end filter segment and the length of said portion of said tobacco rod, whereby said overlap region overlies said rod-end filter segment.

7. The filter cigarette of claim 5 wherein the distance from the mouth end of said inner layer to the inner layer division line is less than the length of said mouth-end filter segment and the distance from the rod-end of said outer layer to the outer layer division line is equal to the sum of the length of said rod-end filter segment and the length of said portion of said tobacco rod, whereby said overlap region overlies said mouth-end filter segment.

8. The filter cigarette of claim 5 wherein the distance from the mouth end of said inner layer to the inner layer division line is less than the length of said mouth-end filter segment and the distance from the rod end of said outer layer to the outer layer division line is less than the sum of the length of said rod-end filter segment and the length of said portion of said tobacco rod, whereby said overlap region overlies both said filter segments.

9. The filter cigarette of claim 1 wherein said first layer is said outer layer and said second layer is said inner layer.

10. The filter cigarette of claim 9 wherein the distance from the mouth end of said outer layer to the outer layer division line is equal to the length of said mouth-end filter segment and the distance from the rod end of said inner layer to the inner layer division line is less than the sum of the length of said rod-end filter segment and the length of said portion of said tobacco rod, whereby said overlap region overlies said rod-end filter segment.

11. The filter cigarette of claim 9 wherein the distance from the mouth end of said outer layer to the outer layer division line is less than the length of said mouth-end filter segment and the distance from the rod end of said inner layer to the inner layer division line is equal to the sum of the length of the rod-end filter segment and the length of said portion of said tobacco rod, whereby said overlap region overlies said mouth-end filter segment.

12. The filter cigarette of claim 9 wherein the distance from the mouth end of said outer layer to the outer layer division line is less than the length of said mouth-end filter segment and the distance from the rod end of said inner layer to the inner layer division line is less than the sum of the length of said rod-end filter segment and the length of said portion of said tobacco rod, whereby said overlap region overlies both said filter segments.

13. The filter cigarette of claim 1 wherein said first and second perforation patterns are identical.

14. The filter cigarette of claim 1 wherein said first and second perforation patterns differ.

15. The filter cigarette of claim 1 wherein said division lines are lines of perforations, said perforations breaking when said filter segments are rotated relative to one another for the first time.

16. The method of manufacturing the filter cigarette of claim 1, said method comprising the steps of:

providing said inner and outer layers of tipping paper;

forming said division line and said first perforation pattern in said inner layer;

forming division line and said second perforation pattern in said outer layer;

applying adhesive to said inner and outer layers except in said overlap region and adhering said layers to form said tipping paper laminate;

providing said tobacco rod and said filter plug; applying adhesive to the inner side of said tipping paper laminate except in said overlap region; and overwrapping said filter plug and a portion of said tobacco rod with said tipping paper laminate.

* * * * *